US005352518A

United States Patent [19]

Muramoto et al.

[11] Patent Number: 5,352,518

[45] Date of Patent: Oct. 4, 1994

[54] COMPOSITE ELASTIC FILAMENT WITH ROUGH SURFACE, PRODUCTION THEREOF, AND TEXTILE STRUCTURE COMPRISING THE SAME

[75] Inventors: Yasuo Muramoto; Kiyoshi Yoshimoto, both of Hofu; Masami Fujimoto, Kudamatsu; Yoshiaki Morishige, Yamaguchi, all of Japan

[73] Assignee: Kanebo, Ltd., Tokyo, Japan

[21] Appl. No.: 112,214

[22] Filed: Aug. 25, 1993

Related U.S. Application Data

[63] Continuation of Ser. No. 835,422, Feb. 19, 1992, abandoned.

[30] Foreign Application Priority Data

Jun. 22, 1990 [JP] Japan ..... 2-165426

[51] Int. Cl.[5] ..... D02G 3/00

[52] U.S. Cl. ..... 428/373; 428/374; 428/370; 428/399; 428/400; 264/210.8; 264/342 RE; 264/171

[58] Field of Search ..... 264/210.8, 342 RE, 171, 264/211.17; 428/373, 374, 370, 399, 400; 2/239, 241, 242, 320

[56] References Cited

U.S. PATENT DOCUMENTS

| | | | |
|---|---|---|---|
| 3,115,745 | 12/1963 | Lathem | 264/342 RE |
| 3,154,611 | 10/1964 | Dinbergs | 264/211.17 |
| 3,361,859 | 1/1968 | Cenzato | 264/210.8 |
| 3,536,803 | 10/1970 | Epstein et al. | 264/342 RE |
| 3,550,369 | 12/1970 | Pitzl | 57/248 |
| 3,558,760 | 1/1971 | Olson | 264/342 RE |
| 3,728,072 | 4/1973 | Orito | 428/400 |
| 3,827,932 | 8/1974 | Orito | 428/400 |
| 3,901,989 | 8/1975 | Hokonoki et al. | 428/373 |
| 4,286,005 | 8/1981 | Berger | 428/397 |
| 4,457,973 | 7/1984 | Matsi et al. | 428/374 |
| 4,663,221 | 5/1987 | Makimura et al. | 264/171 |
| 4,816,094 | 3/1989 | Pomplun et al. | 264/343 RE |
| 4,861,660 | 8/1989 | Ishii | 428/373 |
| 4,970,042 | 11/1990 | Kakiuchi et al. | 264/210.8 |
| 5,164,262 | 11/1992 | Kobayashi et al. | 428/373 |

OTHER PUBLICATIONS

Fairchild's Dictionary of Textiles, 1979 p. 460.

*Primary Examiner*—Patrick J. Ryan
*Assistant Examiner*—N. Edwards
*Attorney, Agent, or Firm*—Flynn, Thiel, Boutell & Tanis

[57] ABSTRACT

A composite elastic filament with a rough surface, consisting of a sheath component composed of a fiber-forming thermoplastic polymer, such as polyamide, polyester or polyolefin, and a core component composed of a fiber-forming elastomer, such as polyurethane or polyester elastomer, wherein the core/sheath conjugate ratio ranges from 1/1 to 100/1 by cross-sectional area and the core portion has a smooth peripheral surface uniformly extending in the direction of the filament axis while the sheath portion covering the core portion has numerous ridges rising along the circumference of the filament and closely spaced along the length of the filament. This filament can be readily produced by the melt conjugate spinning of the core and sheath components at the above-specified conjugate ratio, followed by drawing 1.1- to 10.0-fold and relaxation. The filament has excellent elastic properties, a small surface friction coefficient and a matting effect due to diffuse reflection of light caused by the rough surface, and is agreeable when worn in the form of a textile structure, particularly as lady's stockings.

15 Claims, 7 Drawing Sheets

COMPOSITE ELASTIC FILAMENT WITH ROUGH SURFACE, PRODUCTION THEREOF, AND TEXTILE STRUCTURE COMPRISING THE SAME

This application is a continuation of U.S. Ser. No. 07/835,422, filed Feb. 19, 1992, now abandoned.

TECHNICAL FIELD

This invention relates to core and sheath type composite filaments wherein a sheath portion composed of a fiber-forming thermoplastic polymer and a core portion composed of a fiber-forming elastomer extend along the filament axis, more particularly, composite filaments having a rough surface and an excellent elastic property, and manufacturing processes thereof as well as textile structures comprising such a filament.

BACKGROUND ART

As a filament having discontinuous nodules randomly arranged perpendicularly to the filament axis, there has so far been known a polyester filament having randomly arranged, discontinuous circumferential ridges of submicroscopic size occurring with a frequency between 10 and 130 ridges per millimeter along the length of the filament (U.S. Pat. No. 3,184,369). Further, as a manufacturing process, there has been known a process comprising contacting an as-spun filament with a crack-promoting agent under tension to produce cracks, drawing the filament and then removing the crack-promoting agent (U.S. Pat. No. 3,185,613).

Other than the above, as a process for manufacturing filaments having nodules with a long axial pitch, there has been known a process for producing nodulous filament (having about 0.1–1.0 nodules per 10 mm) by utilizing melt fracture caused by spinning a polymer at a temperature in the vicinity of the melting temperature of the polymer (Japanese Patent Application Publication No. 38-11,851); a process wherein a cooling medium is sprayed immediately after spinning; a process comprising embossing filaments with a rough-surfaced roll during take-up of the filaments after spinning; etc.

in the above-described filament having randomly arranged, discontinuous nodules and its manufacturing process, the course of the process until the filament is obtained is very complicated and, further, the obtained filament is composed mainly of a polyester- or polyamide-based non-elastomer and so has no elastic property.

Alternatively, the process utilizing melt fracture not only produces filaments having nodules with a very long axial pitch but also tends to be lacking in a stabilized operability in spinning. Furthermore, the process of embossing with a rough-surfaced roll poses a problem such that only nodules with a long axial pitch are obtainable, or the like.

As described above, there has not, heretofore been known any filaments having a rough surface characterized by numerous nodules arranged with a short axial pitch, particularly, having a bellows-like structure with a rough surface as well as stretch recovery, which can be industrially easily manufactured.

DISCLOSURE OF INVENTION

An object of the present invention is to provide a novel filament having a rough surface, particularly, a bellows-like structure along the length of the filament, as well as an elastic stretch recovery. Another object is to provide a process for manufacturing such a filament by a melt-spinning process at low cost. A further different object is to provide a textile structure, particularly a stocking, comprising the above filament which gives an excellent feeling to wearers.

The composite elastic filament having a rough surface according to the present invention is, in a core and sheath type composite filament consisting of a sheath portion composed of a fiber-forming thermoplastic polymer and a core portion composed of a fiber-forming elastomer, extending along the length of the filament, characterized in that a core/sheath conjugate ratio is within the range between 1/1 and 100/1 by cross-sectional area, the above core portion has a smooth peripheral surface and the sheath portion covering the core portion has numerous ridges rising along the circumference and closely spaced along the length of the filament.

The above ridges have an axial pitch preferably within the range between about 0.1 and 100 μm.

Further, the filament of the present invention is preferred to have a bellows-like peripheral surface wherein the above ridges have an average length of at least $\frac{1}{3}$ of the circumference of the filament.

The fiber-forming elastomer forming the core portion of the filament according to the invention is preferably a thermoplastic polyurethane, more preferably a cross-linked polyurethane. Additionally, polyester-based elastomers also can be suitably employed.

As a fiber-forming thermoplastic polymer forming the sheath portion of the filament according to the invention, nylon 12 is most preferred. Additionally, polyolefins also can be suitably employed.

The core/sheath conjugate ratio is preferably within the range between 5/1 and 90/1, more preferably between 10/1 and 50/1, by cross-sectional area.

A process for manufacturing the composite elastic filament with a rough surface according to the present invention is characterized by the steps of: conjugate-spinning a fiber-forming thermoplastic polymer as a sheath component with a fiber-forming elastomer as a core component at a core/sheath conjugate ratio between 1/1 and 100/1 by volume to form a core and sheath type composite filament; then drawing the resulting filament at a draw ratio between 1.1 and 10.0 ; and further subjecting the drawn filament to a relax treatment to thereby form on the sheath portion numerous ridges rising along the circumference and closely spaced along the length of the filament.

In the above manufacturing process, the fiber-forming elastomer to be used as a core component is preferably a polyurethane. When this polyurethane is a rigid polyurethane exhibiting a nitrogen content of at least 2.8% by weight, the aforementioned relax treatment is preferably conducted under an elevated temperature.

Alternatively, when the above polyurethane is a flexible polyurethane having a nitrogen content of less than 2.8% by weight, the aforementioned relax treatment will be embodied by tension relaxation after drawing.

The present invention includes textile structures constituted by containing the above composite elastic filament having a rough surface, inter alia, a stocking as a preferable embodiment.

The present invention will be explained hereinafter in more detail.

As a fiber-forming thermoplastic polymer to be applied in the present invention, mention may be made of non-elastomers or the like, such as polyesters; polyamides; and polyolefins, for example, polyethylenes, polypropylenes, polystyrenes and polybutenes; or the like.

Then, at the outset, mention will be made of the sheath component in the case where the core component is a thermoplastic polyurethane.

As a polyamide that is one of typical examples of fiber-forming thermoplastic polymers to be applied in the sheath component, mention may be made of, for example, a low viscosity nylon 6 and a modified nylon 66. Other than the above, preferably employable are nylon 8, nylon 9, nylon 10, nylon 11, nylon 12 or the like, nylon 6/66, ternary polyamides such as nylon 6/12/10 or the like, multicomponent polyamides, and mixtures thereof. Among the others, nylon 12 is particularly suited for application to ladies' stockings or the like.

As a polyester that is another typical example of the thermoplastic polymers, preferred are copolyesters comprising a polyethylene terephthalate as a principal constituent which is copolymerized with at most 50 mole % of isophthalic acid as a dicarboxylic acid ingredient and/or at most 35 mole % of at least one of diethylene glycol, triethylene glycol, neopentyl glycol, butanediol and the like. The percentage of the isophthalic acid ingredient (A mole %) and the percentage of the copolymeric diol ingredient (B mole %) may be appropriately selected in view of tackiness development of the resulting filaments, a proper melt-spinning temperature and the like, so as to satisfy the following relationship:

$$15 \leqq A+B \leqq 50.$$

The sum of A and B exceeding 50 mole % is not preferred because of a tendency for polymer pellets to stick together to form bridgings during drying before spinning, sticking of filaments after spinning, or the like. The sum of A and B less than 15 mole % is also not preferred because the proper melt-spinning temperature will increase to such an extent that the melt viscosity becomes hardly balanced with that of the core component during spinning. The percentage of isophthalic acid is preferably within the range between 15 mole % and 45 mole %.

These thermoplastic polymers, when they are conjugate-spun with a fiber-forming elastomer core component, are desired to have a proper melt-spinning temperature not exceeding the upper limit of the proper melt-spinning temperature of this elastomer. As a measure of the proper melt-spinning temperature, mention may be made of a relative viscosity or melting point temperature. For example, in the case where a polyurethane is applied as a core component, the upper limit of its proper melt-spinning temperature is usually about 238° C. In the case where a thermoplastic polymer to be conjugated with the polyurethane is nylon 6, particularly preferred are those having a relative viscosity of not exceeding 2.3 determined at 25° C. with 100 ml of 98% sulfuric acid dissolving a 1 g nylon sample.

Alternatively, a nylong 66 modified polymer, nylon 8, nylon 9, nylon 10, nylon 11, nylon 12, and copolymers and blend polymers thereof, having a melting point temperature of 80° C.–230° C. determined by differential scanning calorimetry (DSC) are also preferred. Polymers having a melting point temperature exceeding 230° C. are not preferred because the polymers cannot be balanced in melt viscosity during conjugate-spinning with the polyurethane core component having poor melt-stability and heat-resistivity, and further the resulting filament yarns will have a low recovering force.

Polymers having a melting point temperature less than 80° C. are not preferred because of a poor fiber-formability and tackifying. Additionally, as a sheath component in the present invention, polyolefins such as polyethylenes, polypropylenes or the like, polystyrenes, polybutenes or the like are also applicable.

On the other hand, in the case where the core component is a non-polyurethane elastomer, polyamides and polyesters are preferred as a fiber-forming thermoplastic polymer. Those may be either modified or viscosity-lowered as the above or not subjected to any such modification or viscosity-lowering.

The above-described fiber-forming thermoplastic polymers to be used as a sheath component of the filaments according to the present invention can be added with known polymer-modifying additives, for example, delustrants such as titanium dioxide or the like, antioxidants, electroconducting particles, anti-fungus agents, dyes, pigments, compatibilizing agents, or the like.

As a fiber-forming elastomer to be employed as a core component of the filaments according to the present invention, mention may be made of known elastomers, such as polyurethane-based elastomers, polyester-based elastomers, polyamide-based elastomers, polystyrene-based elastomers, or the like. Among the others, the polyurethane-based elastomers and polyester-based elastomers are particularly preferred because of excellent melt-stability, spinnability and elastic property.

The polyurethanes for the core component constituting the present invention are not specifically limited insofar as they are fiber-formable. However, thermoplastic polyurethanes or crosslinked polyurethanes are preferred. The thermoplastic polyurethanes are melt-spinnable polymers which are obtained by reacting a high-molecular diol and an organic diisocyanate with a chain extender.

As the high molecular diols, mention may be made of glycols having terminal hydroxyl groups at the both ends and a molecular weight of 500–5,000, for example, etheric polyols such as polytetramethylene glycols, polypropylene glycols or the like, esteric polyols such as polyhexamethylene adipates, polybutylene adipates, polycarbonate diols, polycaprolactone diols or the like, and mixtures thereof.

As the chain extenders, mention may be made of 1,4-butane diol, ethylene glycol, propylene glycol, bishydroxyethoxybenzene or the like, having a molecular weight of at most 500. Among the others, 1,4-butane diol and bishydroxyethoxybenzen are particularly preferred.

As the organic diisocyanates, mention may be made of tolylene diisocyanate (TDI), 4,4'-diphenylmethane diisocyanate (MDI), non-yellowing diisocyanates such as 1,6-hexane diisocyanate or the like, and mixtures thereof. Among the others, MDI is particularly preferred.

The percentage of nitrogen content (N %) as an index of an MDI content in a polyurethane, relating to the hardness of the polyurethane, is preferred to be in the range between 1.5 and 4.8. The N % can be determined by microorganic analysis. If the N % is less than 1.5%, problems such that the resulting composite filament yarns have a decreased recovering force, spinning stability is deteriorated, or the like, will arise, and so it is not preferred. Contrarily, if the N % exceeds 4.8%, problems such that the range of optimal spinning conditions of the polyurethane extremely narrows, or the like, will arise, and so it is not preferred. The preferred range is between 2.1% and 4.5%.

Such polyurethanes can be incorporated with a known modifying agent, compatibilizing agent or the like used for polyurethanes, such as titanium dioxide, dyes, pigments, UV stabilizers, UV absorbers, antifungus agents, or the like.

In the case where the resulting composite filament yarns require a further increased heat resistivity, recoverability or the like, a crosslinked polyurethane obtained by reacting the above polyurethane with a polyisocyanate may be arranged as the core component. As this crosslinking process, use may be made of the process proposed by the present inventors and disclosed in Japanese Patent Application Publication No. 58-46,573, namely, a process wherein a molten thermoplastic polyurethane is admixed with a polyisocyanate and allophanate crosslinking is completed during or after spinning.

As a polyisocyanate, compounds consisting of a polyol ingredient and an isocyanate ingredient and having at least 2, preferably 2–3 isocyanate groups (NCO groups) in the molecule, are preferred.

As the polyol ingredient, suitably employable are the above-described diols having a molecular weight of 300–4,000 which are used in the synthesis of polyurethanes, and in addition, diol/triol mixtures having an average functionality of hydroxy group brought into between 2 and 3, as well as synthetic polyols having a functionality of 2–3.

Alternatively, as the isocyanate ingredient, use may be made of the above-described diisocyanates which are used in the synthesis of polyurethanes, organic diisocyanate trimers, reaction products of trimethylol propane with an organic diisocyanate, isocyanates having a functionality in the range of 2–3 (for example, carbodiimide-modified isocyanates) or the like, and mixtures thereof.

The reaction of the above both ingredients can be conducted according to any known processes. However, it is preferred to conduct the reaction in such a manner that the isocyanate group content may be in excesses, namely, the reaction product may contain isocyanate groups (NCO groups) in an amount of 3–22% by weight. Needless to say, this amount depends upon the objective physical properties such as heat resistivity, recoverability or the like and polyols employed.

As for the amount of the polyisocyanate to be incorporated, it is preferred to be in the range between 6% and 40% by weight based on the polyurethane/polyisocyanate mixture to be used for the core component. This amount depends upon the NCO group content and the kind of the polyisocyanate to be used. However, more than 40% by weight is not preferred because it will cause uneven mixing and instabilized spinning, or only yarns exhibiting unsatisfactory mechanical properties will be obtained. If it is less than 6% by weight, the yarns will be deficient in heat resistivity, and so it is not preferred. A more preferable amount is in the range between 10% and 30%, by weight.

Thus, a crosslinked structure predominantly comprising allophanate crosslinkages is constructed in the polyurethane core component. Meanwhile, a crosslinked structure constructed mainly with biuret crosslinkages is not preferred, as it will extremely deteriorate spinnability. Namely, since the biuret crosslinkage is formed at a larger rate than the allophanate crosslinkage, viscosity of the system will increase during spinning to such an extent that a stabilized spinning tends to be hardly performed.

Alternatively, polyester-based elastomers employable as the core component of the filament according to the present invention are composed of short chain ester portions as a hard segment, namely, formed from an aromatic dicarboxylic acid and a low molecular weight diol having a molecular weight of at most about 250, and long chain polyether portions and/or long chain polyester portions, as a soft segment. For example, as the aromatic dicarboxylic acid constituting the hard segment, mention may be made of terephthalic acid, isophthalic acid, bibenzoic acid, substituted dicarboxylic acid compounds having two benzene rings, such as bis(p-carboxyphenyl)methane, p-oxy(p-carboxyphenyl)benzoic acid, ethylene-bis(p-oxybenzoic acid), 1,5-naphthalene dicarboxylic acid or the like. Among the others, phenylene dicarboxylic acids, namely, terephthalic acid and isophthalic acid are particularly preferred. On the other hand, as the low molecular weight diol having a molecular weight of at most about 250, mention may be made of ethylene glycol, propylene glycol, tetramethylene glycol, hexamethylene glycol, cyclohexane dimethanol, resorcinol, hydroquinone or the like. Particularly preferred are aliphtic diols containing 2–8 carbon atoms.

Alternatively, as the long chain polyether portions constituting the soft segment, mention may be made of poly(1,2- or 1,3-propyleneoxide)glycols, poly(tetramethyleneoxide)glycols, random or block copolymers of ethyleneoxide and 1,2-propyleneoxide, or the like, having a molecular weight of 500–6,000. Poly(tetramethyleneoxide)glycols are preferred.

As the long chain polyester portions, mention may be made of poly(aliphatic lactone)diols, such as polycaprolactone diols, polyvalerolactone diols or the like. Particularly, polycaprolactone diols are preferred. Other than the above, as the long chain polyester portions, mention may be made of aliphatic polyester diols, for example, reaction products of a dicarboxylic acid, such as adipic acid, sebacic acid, 1,3-cyclohexane dicarboxylic acid, glutaric acid, succinic acid, oxalic acid, azelaic acid or the like, with a low molecular weight diol, such as 1,4-butanediol, ethylene glycol, propylene glycol, hexamethylene glycol or the like. Particularly, polybutylene adipate is preferred.

Among such polyester-based elastomers, polyester/ether-based elastomers composed of a polybuthylene terephthalate as a hard segment and a polytetramethylene glycol having a molecular weight of 600–3,000 as a soft segment are particularly preferred. This is because the hard segment composed of a polybutylene terephthalate having a very high crystallization rate improves shapability which is one of the most eminent features of thermoplastic elastomers and further because the soft segment composed of a polytetramethylene glycol good in low temperature properties can provide the elastomers with well balanced characteristics, such as a low temperature flexural property, water resistance, fatigue resistance or the like.

As an elastomer more improved in weatherability and resistance to heat-aging than the polyester/ether-based elastomers, polyester/ester-based elastomers composed of a polybutylene terephthalate as a hard segment and caprolactone diol having a molecular weight of 600–3,000 as a soft segment are particularly preferred.

In order to apply a yarn to the same use as polyurethane elastomer yarns, it requires to have elastic properties such as elongation, recovery or the like. Accordingly, from the hardness point of view, yarns having a Shore D hardness within the range between 25 and 65 are preferred.

As an example of the above-mentioned polyester-based elastomers, mention may be made of those commercialized, such as HYTREL® (manufactured by Toray-du Pont), PELPRENE® (manufactured by Toyobo Co.), GLYLUX® (manufactured by Dainippon Ink and Chemicals), ARNITEL® (manufactured by Akzo) or the like. These are preferably employable.

Alternatively, polyamide-based elastomers are composed of hard segments and soft segments, similar to the polyurethanes. As the hard segments, a polyamide block of nylons 6, 11 or 12, or besides of nylons 66, 610 or 612, or the like, is used. As the soft segments, a polyether block of polyethylene glycols, polypropylene glycols, polytetramethylene glycols or the like, or an aliphatic polyester diol or the like, is used. Such polyamide-based elastomers exhibit different characteristics depending upon polyamide starting materials constituting the hard segments, polyethers constituting the soft segments, or polyester starting materials, and proportions of hard segments/soft segments.

For example, mechanical strength, resistance to heat, resistance to chemicals, etc. are improved, while rubbery elasticity tends to decrease, with increasing hard segments. Contrariwise, properties such as resistance to cold, softness or the like are improved with decreasing hard segments.

Whether the polyether-based or polyester-based elastomer should be employed may depend upon the use of the composite filament.

From the hardness point of view, a Shore D hardness within the range between 25 and 70, more preferably, within the range between 35 and 65, is desirable from the aspects of physical properties and operability as a composite filaments.

As an example of the above-mentioned polyamide-based elastomers, mention may be made of those commercialized, such as DIAMID® (manufactured by Daicel-Huells), PEBAX® (manufactured by Toray), GLYLUX® (manufactured by Dainippon Ink and Chemicals) or the like. These are preferably employable.

Alternatively, polystyrene-based elastomers are composed of hard segments and soft segments, similar to the polyurethanes. The hard segments have a crystal structure of a polystyrene, and as the soft segments, a polybutadiene, polyisoprene and/or polyethylene/butylene are block-copolymerized with the polystyrene. An elastomer obtained from these can be represented by the denotation, SBS, SIS, or SEBS. Further, with increasing styrene portions, mechanical strength increases, while the hardness also increases whereby rubbery elasticity tends to decrease. Contrarily, with decreasing styrene portions, an inverse tendency appears.

As the above-mentioned polystyrene-based elastomers, mention may be made of those commerialized, such as KRAYTON®, CARIFLEX® (manufactured by Shell Chemicals), RABALON® (manufactured by Mitsubishi Petrochemical), TUFPLENE® (manufactured by Asahi Chemical Ind.), ARON AR® (manufactured by Aron Kasei) or the like. These are preferably employable.

AS the core and sheath type conjugation, mention may be made of an eccentric type, kidney type, concentric type or the like. However, particularly, the concentric circular type is preferred, mainly from the standpoints of spinnability, manufacture feasibility and the like. Needless to say, a little eccentricity is permitted.

As the cross-sectional shape of the composite filament, it may be either circular or noncircular such as oval shape.

The core/sheath conjugate ratio is in the range of 1/1 to 100/1, preferably 5/1 to 90/1, more preferably 10/1 to 50/1, as a cross-sectional area ratio of the filament. A core/sheath conjugate ratio less than 1 is not preferred because the obtained filaments will exhibit extremely poor elastic properties. Contrarily, if this ratio is more than 100, it is liable to enounter difficulties, such as breakages of the sheath portion or the like, during spinning.

In the filaments according to the present invention, the core portion composed of a fiber-forming elastomer has a smooth peripheral shape uniformly extending along the filament axis either in the state of elongation or relaxation of the filament. The sheath portion composed of a fiber-forming thermoplastic polymer covering such a core portion forms numerous ridges rising annularly along the circumference of the filament and contiguously along the length of the filament when the filament is in a tensionless state after relax treatment. The configuration and dimension of such ridges can be varied arbitrarily. Namely, the axial pitch, height, width, etc. of the ridges can be varied with the kind of polymer employed, conjugate ratio, fineness of the filament, etc. For example, the dimension of the pitch increases with decreasing core/sheath conjugate ratio and, contrariwise, the pitch decreases with increasing conjugate ratio. In many cases, the ridges are formed considerably regularly. However, in the case where a copolyester is used as a sheath component and a polyurethane-based elastomer is used as a core component, somewhat slanting or irregularly shaped ridges may partly formed. Even such cases are within the scope of the present invention insofar as the filament has numerous ridges or bulging portions rising along the circumferential direction of the filament.

The averaged axial pitch of the above-mentioned ridges is within the range of 0.1 to 100 μm. The height of the ridges, though it depends upon the conjugate ratio, is at most about 50 μm. Such risen ridges of the sheath and the smooth surface of the core define vacancies inside which decrease or disappear upon elongation and reproduce upon relaxation of the filament. Thus, the vacancies serve to buffer stresses forming on the sheath portion upon stretching and contracting movements of the composite elastic filaments and act to assist the core portion to recover elastically.

By adequately selecting conditions, such as polymer combinations, a core/sheath conjugate ratio, or the like, it is possible to provide filaments with a bellows-like outer surface configuration with ridges having an average length of at least $\frac{1}{3}$ of the circumference of the filament. Such a bellows-like filament is a typical embodiment of the composite filament according to the present invention, having a rough surface with a small frictional coefficient. Textile structures composed of this filament, particularly clothings to contact directly with human skin, whereas they closely contact due to the elasticity thereof, are free from "greasy feeling" like polyurethane elastic yarns, and give a comfortable feeling to wearers, such as cool and fresh feelings, slippery feeling or the like. Furthermore, the filaments of the present invention surprisingly have an excellent anti-electrostatic property and moisture retaining property which are conjectured to be caused by the special surface configuration thereof.

The process for manufacturing the filaments according to the present invention will be described hereinafter.

The manufacturing process of the filaments according to the present invention comprises the steps of: melt-conjugate spinning a fiber-forming thermoplastic polymer as a sheath component and a fiber-forming elastomer as a core component, at a core/sheath conjugate ratio of 1/1–100/1 by volume; then drawing the spun composite filament at a draw ratio of 1.1–10.0 under a heating or non-heating condition; and then subjecting the drawn filament to a relax treatment.

More concretely, in the outset, a thermoplastic polymer and, for example, a polyurethane are severally melted with respective extruders and conjugate-spun according to a known process into a core and sheath type composite filament consisting of the former as a sheath and the latter as a core. In the case where a crosslinked polyurethane is arranged in the core, a polyisocyante is injected into a molten polyurethane by a known process, before the melt-extruded polyurethane enters a conjugate-spinning spinneret, and the both polymers are mixed together by a static mixer (for example, a Kenics static mixer). The core/sheath conjugate spinning may be conducted by arranging this mixture in the core and a thermoplastic polymer melted by a separate extruder in the sheath.

In designing a core/sheath conjugate-spinning spinneret with a core/sheath conjugate ratio of, for example, at least 15, it is preferred to devise a structure of the portion where flow passages of the sheath component and core component meet one another, as shown in FIG. 1, wherein (1) a depth D of an approach of the sheath component B is decreased to, for example, 2 mm or less, (2) a space H between the lower end of the conduit for introducing the core component (a flow passage 1 of an inner orifice) and the upper end of the orifice 2 for extruding finally conjugated core and sheath is decreased to, for example, 0.05–1.5 mm, and the like.

In such a system, though there may be the case where the obtained filaments are inferior in physical properties immediately after spinning, a remarkable improvement in the physical properties is recognized when left to stand at room temperature, for example, for 2–7 days. The reason is assumed to be the so-called alophanate crosslinkages are formed in the system by a reaction of isocyante groups with urethane bonds in the core. Further, a reaction with the sheath component polymer is also assumed. Accordingly, incorporation of a polyisocyanate into the core component is preferred also from the viewpoint of improvement of compatibility between the core and sheath components.

The filaments of the present invention can be readily manufactured by drawing the thus obtained filament yarns and subjecting the drawn yarn to a relax treatment, using a draw-relax treating apparatus provided with delivery rolls, stretching rolls and takeup rolls.

Though it depends upon combinations of the core and sheath polymers or spinning conditions, the draw ratio in the drawing step is within the range of 1.1 to 10.0.

The relax treatment can be conducted continuously and successively with the above-described drawing step, by overfeeding between stretch rolls and takeup rolls. Alternatively, it also can be conducted by treating once taken-up bobbins with a separately installed overfeed mechanism. In either case, it is preferred to make a total draw ratio (a denier ratio of undrawn yarn to final yarn after drawing and relaxing) in the above draw-relax treatment to be 1.02–9.0. Needless to say, heat treatment may be conducted in mid course of these steps, if required.

When the core component has relatively a low hardness, namely, for example, when the polyurethane has a nitrogen content of less than 2.8% by weight, only tension relaxation, such as overfeeding, tension-releasing or the like, after drawing can attain a relax treatment effective enough to develop numerous ridges on the sheath portion even at room temperature. Alternatively, when the core component has relatively a high hardness, for example, when the polyurethane has a nitrogen content of at least 2.8% by weight, since the core component is apt to be tentatively set in an elongated state by drawing, it is preferred to conduct relax treatment by elevating temperature to release the set. Though it depends upon the kind and hardness of the core component elastomers, the kind of sheath components conjugated therewith, the core/sheath conjugate ratio, etc., the heating temperature is generally at least about 40° C., preferably at least 60° C., more preferably at least 80° C. The relax treatment under an elevated temperature also can be conducted after fabricating textile structures, such as knitted goods, woven fabrics or the like, for example, making use of heating in the step of dyeing, finishing or shaping treatment.

BEST MODE FOR CARRYING OUT THE INVENTION

The present invention will be explained hereinafter by way of example which is, however, not intended to limit the present invention.

EXAMPLE 1

Fiber-forming thermoplastic polymer

Copolyamide (the tradename: 5013B, a nylon 6/66 copolymer manufactured by Ube Industries, Ltd.).

Fiber-forming elastomer

① Polyurethane—a thermoplastic polyurethane having a 3.0% nitrogen content (a reaction product of a polyhexamethylene diol having a molecular weight of 2,000, butanediol and p,p'-diphenylmethane diisocyanate, having a relative viscosity in dimethylformamide at 25° of 2.13).

② Polyisocyanate—a compound having a 6.3% NCO group content, obtained by reacting 1 mole of polycaprolactone diol having a molecular weight of 1,250 with 2.1 moles of p,p'-diphenylmethane diisocyanate.

The above thermoplastic polyurethane was melted in an extruder. The resulting melt was incorporated in mid course of flow with 18% by weight of the above polyisocyanate by a known apparatus for feeding additives and thoroughly mixed by a static mixer equipped with 35 mixing elements (manufactured by Kenics). On the other hand, the above copolyamide was melted in a separate extruder. The above two melts were severally metered and introduced into a conjugate-spinning spinneret having 8 orifices of a 0.5 mm diameter for spinning a concentric circular core and sheath type composite filament with a core/sheath conjugate ratio of 12/1. Thus, a 40 denier monofilament was spun at a spinning rate of 500 m/min. As an oiling agent, an emulsion oiling agent for polyamide was used.

With an apparatus provided with delivery rolls, draw rolls and takeup rolls, this filament was subjected to a draw-relax treatment at room temperature under conditions of a draw ratio of 3.0 times and a total draw ratio of 1.5 times.

The thus obtained filament had a bellows-like structure such as follows:

The axial pitch of the ridges=4.0 μm on an average, and

The height of the ridges=2.3 μm on an average.

Figure 1:
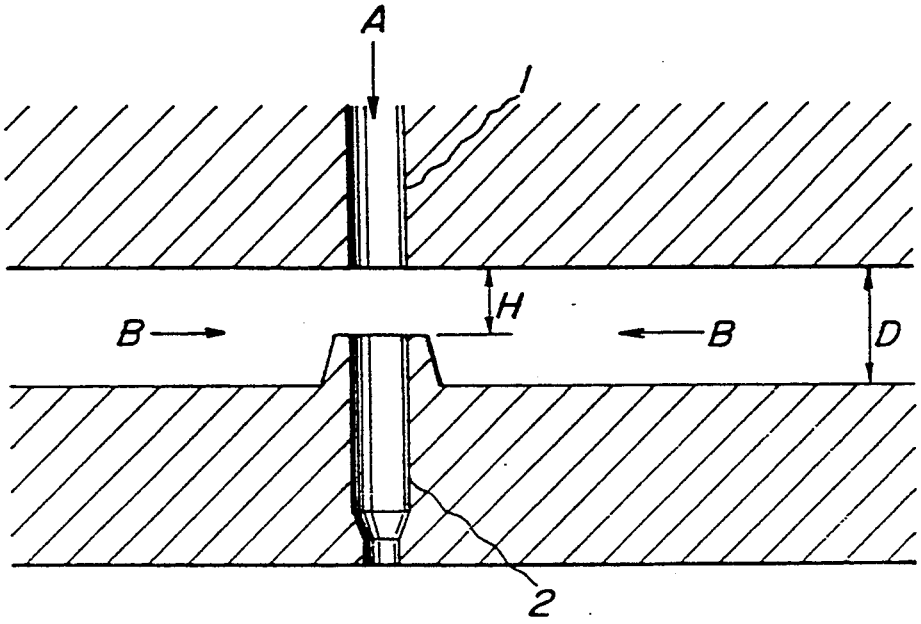
FIG. 1 is a vertical sectional view showing a main portion of a conjugate-spinning spinneret for spinning the filaments of the present invention.
Figure 2A:
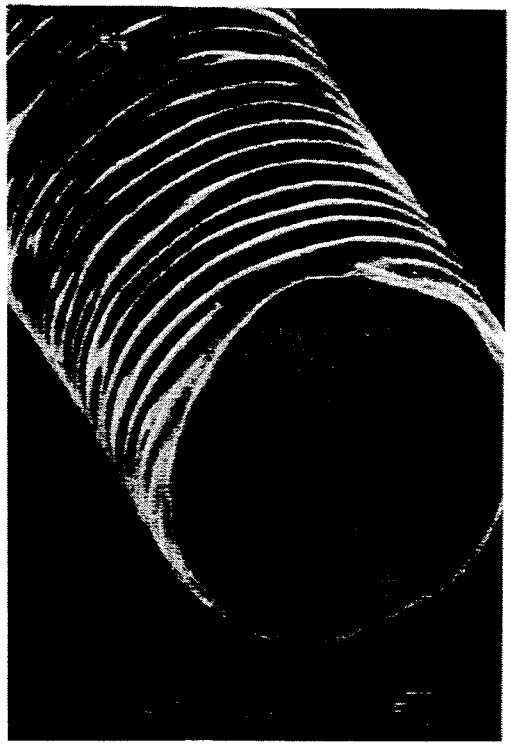
FIGS. 2*a* and 3*a* are photomicrographs of a composite elastic filament of the present invention with rough surface, particularly having a bellows-like structure.

A photomicrograph of a side elevation of this filament is shown in FIG. 2*a*.

It is understood from FIG. 2*a* that this filament has a very regular bellows-like structure wherein the ridges extend continuously along the circumferential direction. Additionally, FIG. 2b is a partial enlargement of the surface shown in FIG. 2*a*.

EXAMPLE 2

Figure 3A:
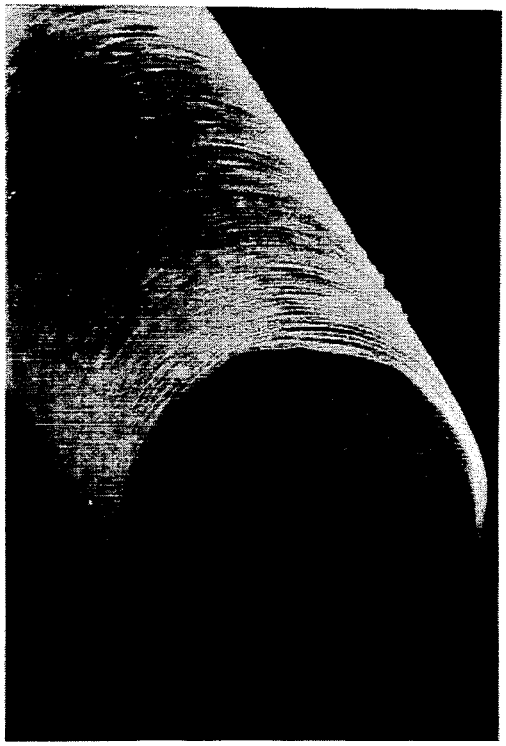
Figure 3B:
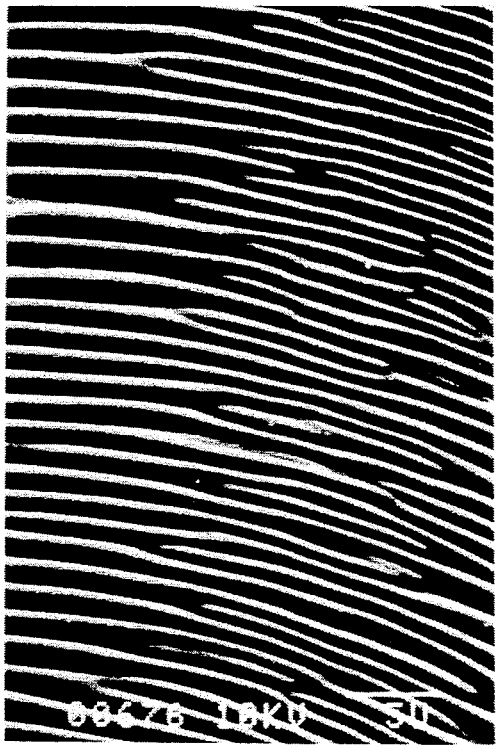

Likewise, a filament was spun at exactly the same conditions except that the core/sheath conjugate ratio was 20/1 by cross-sectional area of the filament. The resulting filament was subjected to a draw-relax treatment at room temperature under conditions of a draw ratio of 3.6 times and a total draw ratio of 1.5 times. The thus obtained filament had a side view as shown in FIG. 3*a*. FIG. 3*b* is a partial enlargement of the surface shown in FIG. 3*a*.

Figure 2B:
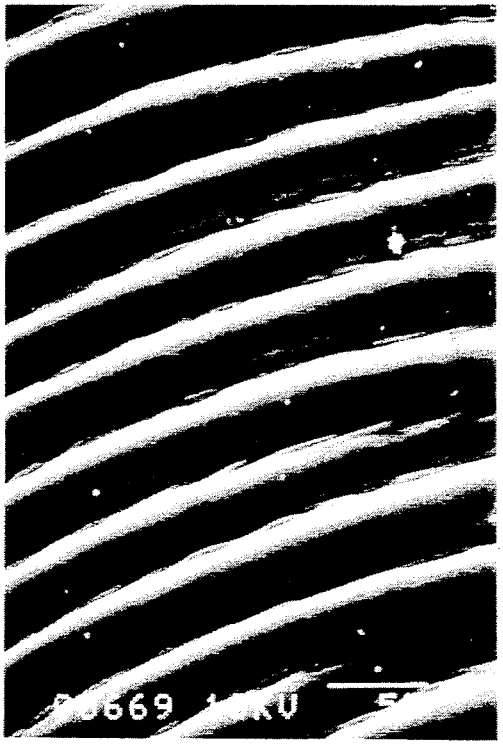
FIGS. 2*b* and 3*b* are enlargements of the surface of the filaments respectively of FIGS. 2*a* and 3*a;*

It is understood from these Figures that as compared with FIGS. 2*a* and 2*b*, the axial pitch of the ridges of the bellows decreases with increasing core/sheath conjugate ratio, namely, with decreasing sheath component proportion.

This filament had a bellows-like structure such as follows:

The axial pitch of the ridges=1.1 μm on an average, and

The height of the ridges=1.0 μm on an average.

Figure 4:
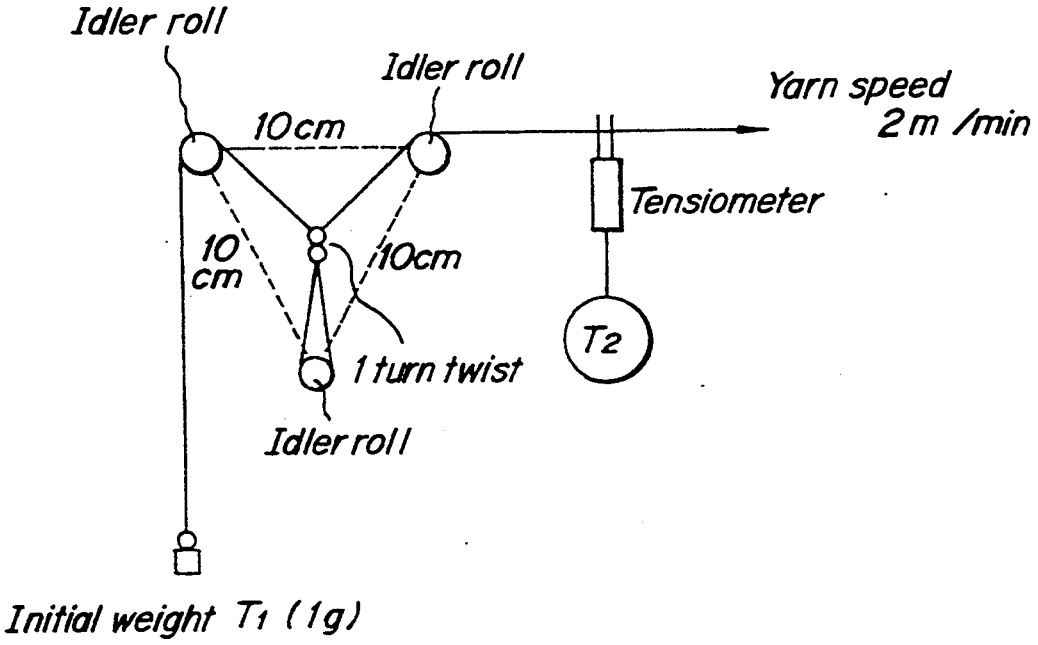
FIG. 4 is a schematic view illustrating an apparatus for measuring an inter-filament frictional force.

Further, as the result of measurement of an inter-filament frictional force (F/F) of this filament, it was 2.8 g. A filament having not been subjected to the draw-relax treatment, namely, having no bellows-like structure, exhibited an F/F of 3.3 g. Thus, it was found that the bellows-like structure largely decreases the friction. The inter-filament frictional force (F/F) is determined herein as follows:

Monofilaments are plied into a 400 total denier yarn (for example, 10 ends of a 40 denier monofilament are plied to produce a 400d/10 filament yarn). A secondary tension ($T_2$) of this yarn is measured by a crossing method as shown in FIG. 4. In FIG. 4, the initial load ($T_1$) is 1 g, the yarn crossing is one twist (a 360° turn) and the yarn travel speed is 2 m/min.

On the other hand, in order to evaluate the recoverability of this filament, a 100% elongation was repeated twice and the permanent strain (the point where the second contractile stress became zero) was measured.

As the result, the permanent strain was 8%. Incidentally, a filament without bellows before the draw-relax treatment had a permanent strain of 15%. Thus, the outstanding effect of the bellows structure is understood.

EXAMPLE 3

Fiber-forming polymer

Nylon 12 (the tradename: L 1600, manufactured by Daicel-Huells)

Fiber-forming elastomer

① A thermoplastic polymer—polyurethanes (of the same composition as Example 1) having nitrogen contents of 2.7%, 3.2% and 4.4%, respectively.

② Polyisocyanate—a viscous compound obtained by reacting 24.4 moles of a bifunctional polycaprolactone having a molecular weight of 1,250 and 4.3 moles of a trifunctional polycaprolactone having a molecular weight of 1,250 with 71.2 moles of p,p'-diphenylmethane diisocyanate.

Incorporating 14% by weight of the polyisocyanate, the above core and sheath components were spun at a core/sheath conjugate ratio of 12/1 in the same manner as Example 1. The resulting 40 denier monofilament was drawn 2.0 times its original length at room temperature with a known apparatus provided with delivery rolls, draw rolls and takeup rolls.

The denier of the obtained filament is shown in Table 1.

TABLE 1

| N % | 2.7 | 3.2 | 4.4 |
|---|---|---|---|
| Denier | 25.6 | 19.7 | 20.3 |

It is understood from Table 1 that the filament comprising a core component having an N content as low as 2.7% has a fineness unset, while the filament having a core component of an N content of 3.2 or 4.4 has a fineness precisely set.

Among the above, with a two-fold drawn yarn comprising a core component having an N content of 3.2%, a panty stocking was knit on a four-feeder knitting machine (Automatic Hosiery Knitter, manufactured by Nagata Seiki). Then, the stocking was dyed with an acidic dye at 100° C., followed by steam-setting at 114° C.

Figure 5A:
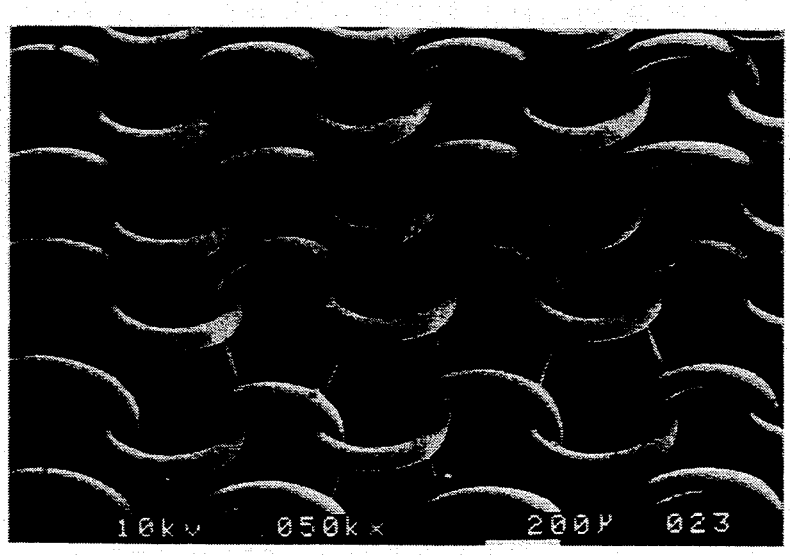
FIG. 5*a* is a photomicrograph showing knit stitches of a stocking according to the present invention.
Figure 5B:
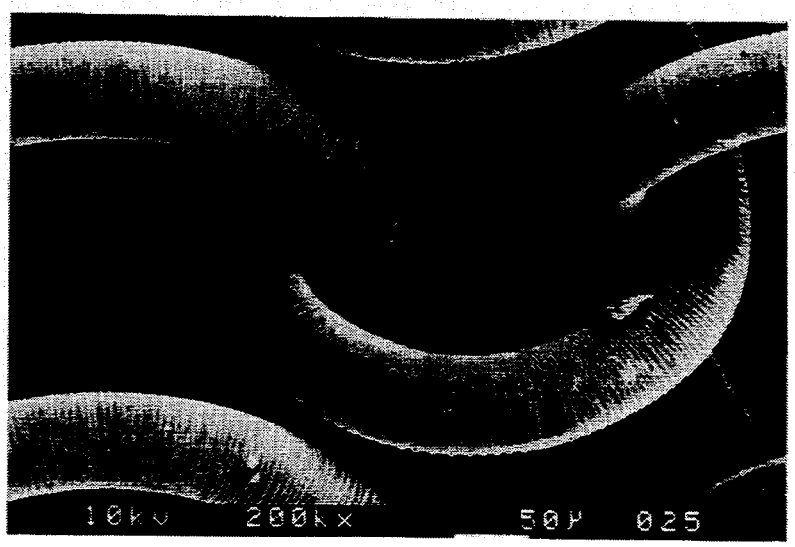
FIG. 5*b* is a partial enlargement of FIG. 5*a;*
Figure 6:
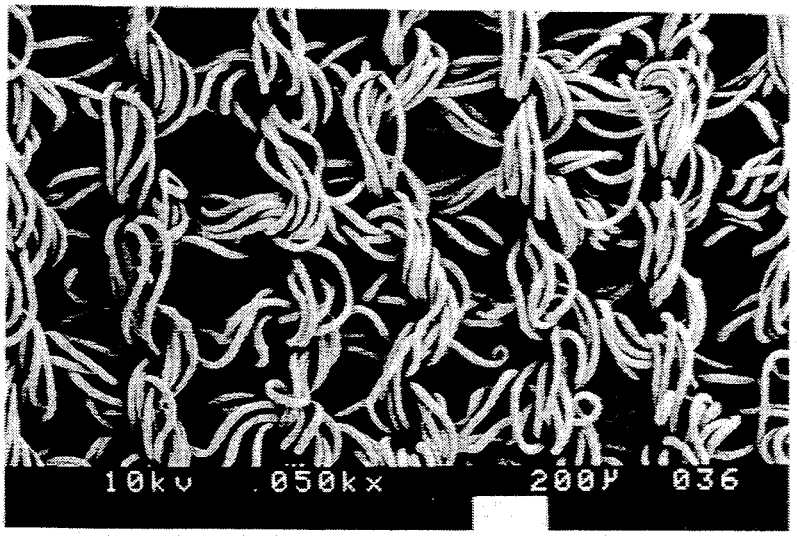
FIG. 6 is a photomicrograph showing knit stitches of a stocking knit with a nylon-6 woolly texturized yarn, as a comparative example.

The feature of the knit stitches in the panty stocking product is shown in FIG. 5*a*. FIG. 5*b* shows a partially enlargement thereof. It is understood from these photographs that this filament is set closely to about 20 deniers before dyeing, whereas it recovers to about 40 deniers after dyeing. FIG. 6 shows a fabric knit with a woolly nylon 6 texturized filament as a comparative.

It is understood from these photographs that the panty stocking knit with the filament of the present invention has a very beautiful appearance and an excellent sheerness.

With respect to this panty stocking, slipperiness of the leg top portion was measured. The result is shown in Table 2.

TABLE 2

| | Slipperiness (°) |
|---|---|
| Panty stocking knit with a draw-relax treated yarn | 16.3 |
| Panty stocking knit with a yarn without draw-relax treatment | 21.4 |

The slipperiness was determined as follows:

An aluminum board was inserted into a panty stocking. Then, a 22.8 g copper weight was put thereon and the aluminum board was inclined. The angle of inclination when the weight started to slip down represented the slipperiness. Accordingly, the smaller the angle, the higher the slipperiness.

It is understood from Table 2 that the panty stocking knit with the filament of the present invention has an excellent slipperiness.

In the next place, this panty stocking was measured for stretch recovery characteristics. For comparison, the same measurement was conducted with a panty stocking composed of a single covering yarn (SCY) consisting of 20 denier polyurethane core yarn and 13 denier/3 filament false-twisted texturized woolly covering yarn entwined therearound in S- or Z-direction. The results are shown in Table 3.

TABLE 3

| | Characteristics at 80% stretch | | |
|---|---|---|---|
| Sample | ⑤$S_1$/①$S_0$ (%) | ⑤$S_1$/⑤$S_0$ (%) | ⑤$S_1$ (g) |
| Panty stocking knit with the yarn of the invention | 50 | 64 | 450 |
| Panty stocking knit with the SCY | 42 | 64 | 525 |

In the above Table, the item "characteristics at 80% stretch" is meant by characteristics of a leg-top portion when it is stretched by 80%, after 5 repetitive 25 cm stretches in the lateral direction. For example, the ⑤$S_1$/⑤$S_0$ means a ratio of a contractile stress at the fifth 80% stretch to a tensile stress at the first 80% stretch. The ⑤$S_1$/⑤$S_0$ means a ratio of a contractile stress at the fifth 80% stretch to a tensile stress at the 5th 80% stretch. The ⑤$S_1$ means a contractile stress at the 5th 80% stretch. The higher these values, the more excellent the stretch recovery characteristics.

It is understood from Table 3 that the panty stocking according to the present invention is substantially comparable to the panty stocking composed of SCY.

EXAMPLE 4

Fiber-forming thermoplastic polymer

The same polymer as Example 3 was used.

Fiber-forming elastomer

A thermoplastic polyester-based elastomer (the trademark: HYTREL4767, manufactured by Toray-du Pont: a Shore D hardness of 40).

The above nylon 12 and polyester-based elastomer were melted severally in separate extruders and introduced into a conjugate-spinning spinneret having 4 orifices of a 0.5 mm diameter for spinning a concentric circular core and sheath type composite filament with a core/sheath conjugate ratio of 20/1 by cross-sectional area. Thus, a 70 denier monofilament was spun at a spinning rate of 500 m/min. As an oiling agent, an emulsion oiling agent for polyamide was used.

Figure 7:
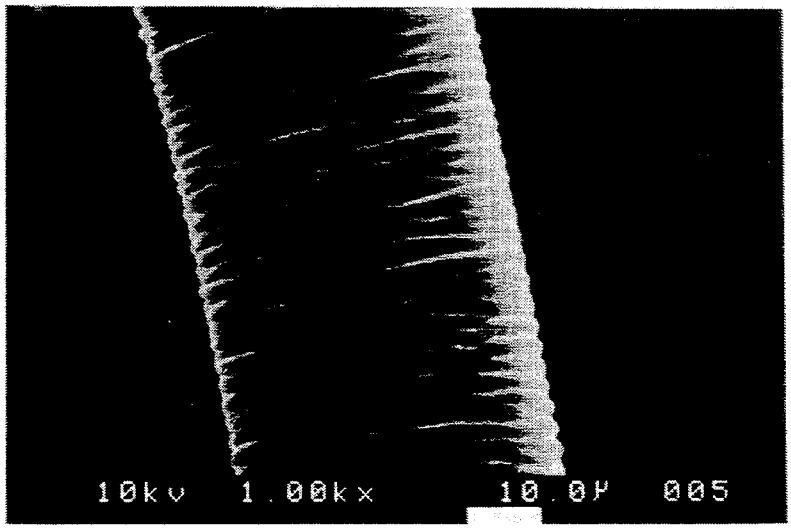
FIGS. 7 and 8 are photomicrographs of a monofilament according to the present invention.

This filament was drawn 6.0 times its original length at room temperature. Then, a relax treatment into a total draw ratio of 4 times was conducted. A photomicrograph of the resulting filament is shown in FIG. 7.

EXAMPLE 5

Fiber-forming thermoplastic polymer

Polyethylene (the trade name: PE356, manufactured by Tosoh Corp.)

Fiber-forming elastomer

The same polymer as Example 1 was used.

In the same manner as Example 1, a 50 denier filament containing 15% of polyisocyanate and having a core/sheath conjugate ratio of 11/1 was obtained. This filament was drawn 6 times its original length at room temperature. Then, the drawn filament was subjected to a relax treatment into a total draw ratio of 3 times and soaked in hot water at 100° C. for 1 minute.

Figure 8:
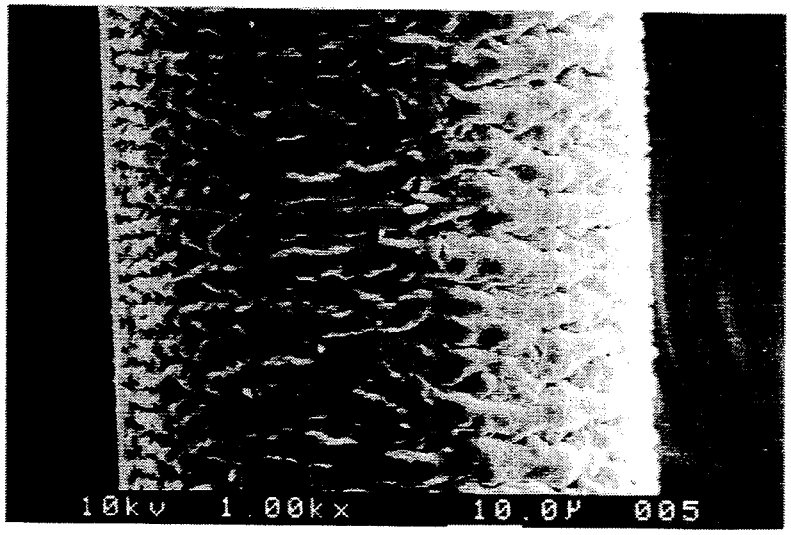

A photomicrograph of the resulting filament is shown in FIG. 8.

Industrial Applicability

As explained above, the filament according to the present invention can be readily obtained by a melts-pinning process. In addition, since the obtained filament has a rough surface, particularly a bellows-like structure, inter-filament frictional resistance is low and tactile properties are excellent.

Additionally, by virtue of a peculiar surface structure, the filament has a matting effect. Namely, it has a dull gloss due to diffuse reflection of light caused by incessant variation of the surface angle reflecting incident light thereupon.

Further, since this filament itself also has a stretch recovery, it can be suited for application in various uses. For example, if it is used for stockings, those having functions such as sheerness, good tactile properties or the like, can be obtained.

Furthermore, it was found surprisingly that this filament is excellent in anti-electrostatic property and moisture retention, so that an extensive use is expected.

The stockings referred to in this invention include all kinds of over-knee stockings, full-length stockings up to groin and panty stockings combining a stocking portion with a panty portion, which are knit with the composite filament yarn of the invention alone or in combination with an ordinary nylon yarn, a false-twisted yarn, a covering yarn comprising a polyurethane filament core yarn, or the like, by means of mix-knitting or blend-spinning.

We claim:

1. A composite elastic filament consisting of a sheath portion composed of a fiber-forming thermoplastic polymer and a core portion composed of a fiber-forming elastomer, extending along the filament axis, which is characterized in that a core/sheath conjugate ratio is within the range between 5/1 and 90/1 by cross-sectional area, said core portion has a smooth peripheral surface and the sheath portion covering said core portion has numerous ridges rising along the circumference of the filament and closely spaced along the length of the filament.

2. The filament according to claim 1, wherein said ridges have an average length of at least 1/3 of the circumference of the filament.

3. The filament according to claim 1, wherein said elastomer is a thermoplastic polyurethane.

4. The filament according to claim 1, wherein said elastomer is a crosslinked polyurethane.

5. The filament according to claim 1, wherein said elastomer is a polyester-based elastomer.

6. The filament according to claim 1, wherein said fiber-forming thermoplastic polymer is nylon 12.

7. The filament according to claim 1, wherein said fiber-forming thermoplastic polymer is a polyolefin.

8. The filament according to claim 1, wherein said core/sheath conjugate ratio is within the range between 10/1 and 50/1 by cross-sectional area.

9. A process for manufacturing a composite elastic filament characterized by the steps of: conjugate-spinning a fiber-forming thermoplastic polymer as a sheath component with a fiber-forming elastomer as a core component at a core/sheath conjugate ratio between 5/1 and 90/1 by volume to form a core and sheath composite filament; then drawing the resulting filament at a draw ratio between 1.1 and 10.0; and further subjecting the drawn filament to a tension relaxation treatment to thereby form on the sheath portion numerous ridges rising along the circumference of the filament and closely spaced along the length of the filament.

10. The process according to claim 9, wherein said elastomer is a polyurethane.

11. The process according to claim 10, wherein said polyurethane has a nitrogen content of at least 2.8% by weight and said relaxation treatment is conducted under an elevated temperature.

12. The process according to claim 10, wherein said polyurethane has a nitrogen content of less than 2.8% by weight and said relaxation treatment is conducted by means of tension relaxation after drawing.

13. The process according to claim 9, wherein said thermoplastic polymer is nylon 12.

14. The process according to claim 9, wherein said thermoplastic polymer is a polyolefin.

15. The process according to claim 9, wherein said core/sheath conjugate ratio is between 10/1 and 50/1 by volume.

* * * * *